US006244885B1

(12) United States Patent
Iwahori

(10) Patent No.: US 6,244,885 B1
(45) Date of Patent: Jun. 12, 2001

(54) LOW CONNECTING RESISTANCE CONNECTOR

(75) Inventor: Yoshihiro Iwahori, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/505,699

(22) Filed: Feb. 17, 2000

(30) Foreign Application Priority Data

Mar. 9, 1999 (JP) ..... 11-061970

(51) Int. Cl.[7] ..... H01R 13/15; H01R 13/62
(52) U.S. Cl. ..... 439/263; 439/852
(58) Field of Search ..... 439/263, 852, 439/259

(56) References Cited

U.S. PATENT DOCUMENTS 4,118,093 * 10/1978 Obeissart ..... 439/263
5,411,406 * 5/1995 Kondo ..... 439/263
6,083,023 * 7/2000 Kamath ..... 439/263

FOREIGN PATENT DOCUMENTS 5-62740 3/1993 (JP) .
5-121128 5/1993 (JP) .

* cited by examiner

*Primary Examiner*—Brian Sircus
*Assistant Examiner*—Hae Moon Hyeon
(74) *Attorney, Agent, or Firm*—Morgan, Lewis & Bockius LLP

(57) ABSTRACT

A connector includes a male connector having a strip-like male terminal received therein, and a female connector which has a female terminal received therein, and can be generally inserted in and connected to the male connector, the female terminal being capable of holding the male terminal. A gap between the holding piece portion and a wall portion is not smaller than the thickness of the male terminal, and when the female connector is inserted into the male connector, the holding piece portion is pressed toward the other portion by an arm member of the pressing means.

2 Claims, 4 Drawing Sheets

LOW CONNECTING RESISTANCE CONNECTOR

BACKGROUND OF INVENTION

1. Field of Invention

This invention relates to a connector in which a connection resistance, developing when connecting male and female connectors together in a telescopic manner, is reduced.

2. Related Art

A connector 50, shown in FIG. 4, comprises a male connector 53 of a square tubular shape, having a strip-like male terminal 51 received therein, and a female connector 54 of a square tubular shape which has a female terminal 52 received therein, and can be generally telescopically inserted in and connected to the male connector 53 so that the male terminal 51 can be connected to the female terminal 52 capable of holding the male terminal 51 in a direction of a thickness thereof (see JP-A-5-121128; prior art).

The male connector 53 includes a generally L-shaped lid portion 55 connected to an edge of an opening through a thin hinge. The lid portion 55 is closed (as indicated in a dots-and-dash line in FIG. 4) after the female connector 54 is inserted into the male connector 53, so that the female connector 54 is held against withdrawal from the male connector 53.

The female terminal 52 has a generally square tubular shape, and includes a curved strip-like holding piece portion 57 formed integrally with a wall portion 56.

A convexly-arcuate surface of the holding piece portion 57 is disposed in closely-spaced, opposed relation to an inner surface of a wall portion 58. The holding piece portion 57 is urged away from the wall portion 58 by an arm member 59 provided at an outer side of the female connector 54.

The arm member 59 is connected to the female connector 54 through a thin hinge, and a contact portion 61 of this arm member is held in contact with the convexly-arcuate surface of the holding piece portion 57 through a communication hole 60, formed in the female connector 54, and a through hole 58A formed through the wall portion 58.

In this connector 50, when the female connector 54 is inserted into the male connector 53, the arm member 59 is pressed by the inner surface of the male connector 53, and therefore the contact portion 61 presses the holding piece portion 57, so that the holding piece portion 57 is moved away from the wall portion 58.

Therefore, in this connector 50, a connection resistance, developing when the male terminal 51 is connected to the female terminal 52 in such a manner that the male terminal 51 is held between the wall portion 58 and the holding piece portion 57, can be made extremely small.

In the above conventional construction, in the case where the distance or gap between the wall portion 58 and the holding piece portion 57 is too small, the connection resistance, developing during the insertion of the female connector 54 into the male connector 53, can not be adequately reduced, and in the case where the distance between the wall portion 58 and the holding piece portion 57 is too large, there is a possibility that the male terminal 51 is incompletely connected to the female terminal 52.

Therefore, in this conventional construction, the relative positions of the female terminal 52 and the female connector 54, as well as the pressing dimension of the arm member 59, is important, and therefore high shape accuracy, dimensional accuracy and position accuracy are required for the constituent members, which invites a problem that the cost becomes high.

Particularly in this conventional construction, when forming the female terminal 52 by pressing, it is necessary to effect an extremely-strict spring force control so that the holding piece portion 57 can have desired resiliency, and this invites a problem that the cost of the parts further increases.

SUMMARY OF INVENTION

With the above problems in view, it is an object of this invention to provide a connector in which male and female terminals can be connected together with a small force without causing an incomplete connection, and besides the cost of parts can be reduced.

The above object has been achieved by a connector of the present invention comprising a male connector of a tubular shape, having a strip-like male terminal received therein, and a female connector of a tubular shape which has a female terminal received therein, and can be generally telescopically inserted in and connected to the male connector so that the male terminal can be connected to the female terminal having a pair of holding portions capable of holding the male terminal therebetween in a direction of a thickness of the male terminal; provided in that there is provided pressing means for pressing one of the holding portions toward the other when the female connector is inserted into the male connector.

The female terminal may be of the type in which a convexly-arcuate surface of a curved strip-like holding piece portion is disposed in opposed relation to a flat wall portion of a square tubular portion as of a conventional female terminal, or may be of the type in which convexly-arcuate surfaces of a pair of curved strip-like holding piece portions are disposed in opposed relation to each other.

The pressing means may comprise an arm member for pressing the holding portion provided on the female connector as in the conventional construction. Alternatively, the pressing means may be of the type in which a projection, formed on the inner surface of the female connector, presses the holding portion through a slit, formed in the female connector, during the insertion of the female connector into the male connector.

The pressing means is not limited to the type for pressing one of the pressing portions toward the other, but may be of the type for pressing the two holding portions toward each other.

In the connector of this construction, the two holding portions are moved toward each other by the pressing means as the female connector is inserted into the male connector, and therefore the male and female terminals can be positively connected together.

In this connector, it is only necessary that the male terminal should finally be held between the holding portions through the pressing means, and therefore high precision is not required for the initial gap between the two holding portions, the shape, dimensions, position of the constituent members, and the cost of the parts can be reduced as compared with the conventional construction.

In the invention, the gap between the two holding portions is set to a value not smaller than the thickness of the male terminal, and by doing so, a connection resistance, developing when connecting the male and female terminals together, can be made extremely small.

In the invention, the pressing means includes a communication portion, formed through a wall of the female connector in a direction of a thickness thereof, and a pressing member received in the communication portion, and the pressing member projects outwardly beyond an outer surface of the female connector, and is held in contact with one of the holding portions.

In the connector of this construction, since the pressing member is provided on the female connector, existing parts male terminal and male connector can be used.

DETAILED DESCRIPTION OF PREFERRED EMBODIMENTS

A preferred embodiment of the present invention will now be described in detail with reference to the drawings.

Figure 4:
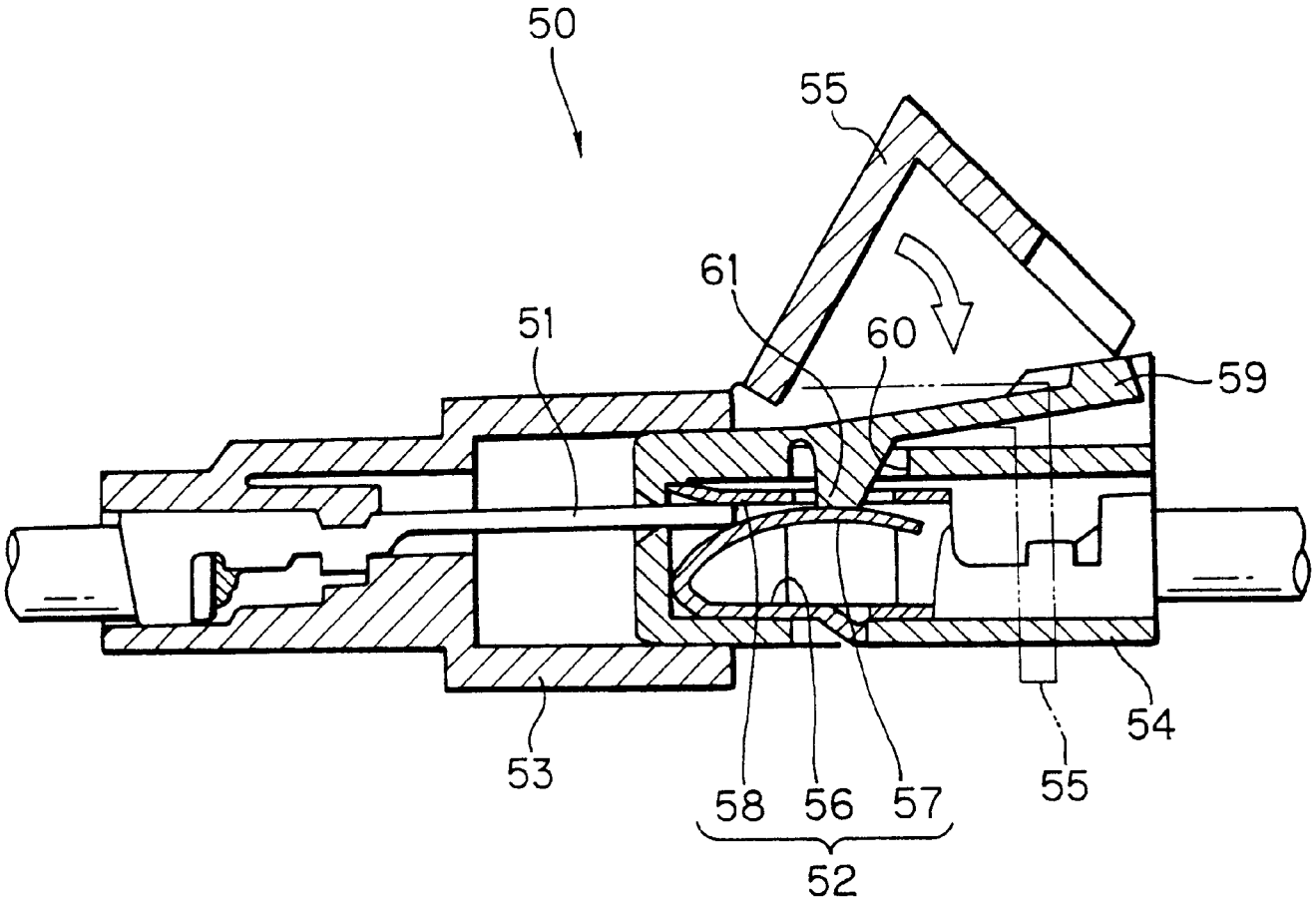
FIG. 4 PRIOR ART
FIG. 4 is a cross-sectional view of a conventional connector.

In the embodiment, those members, already described with reference to FIG. 4, will be designated by corresponding reference numerals, and description thereof will be simplified or omitted.

Figure 1:
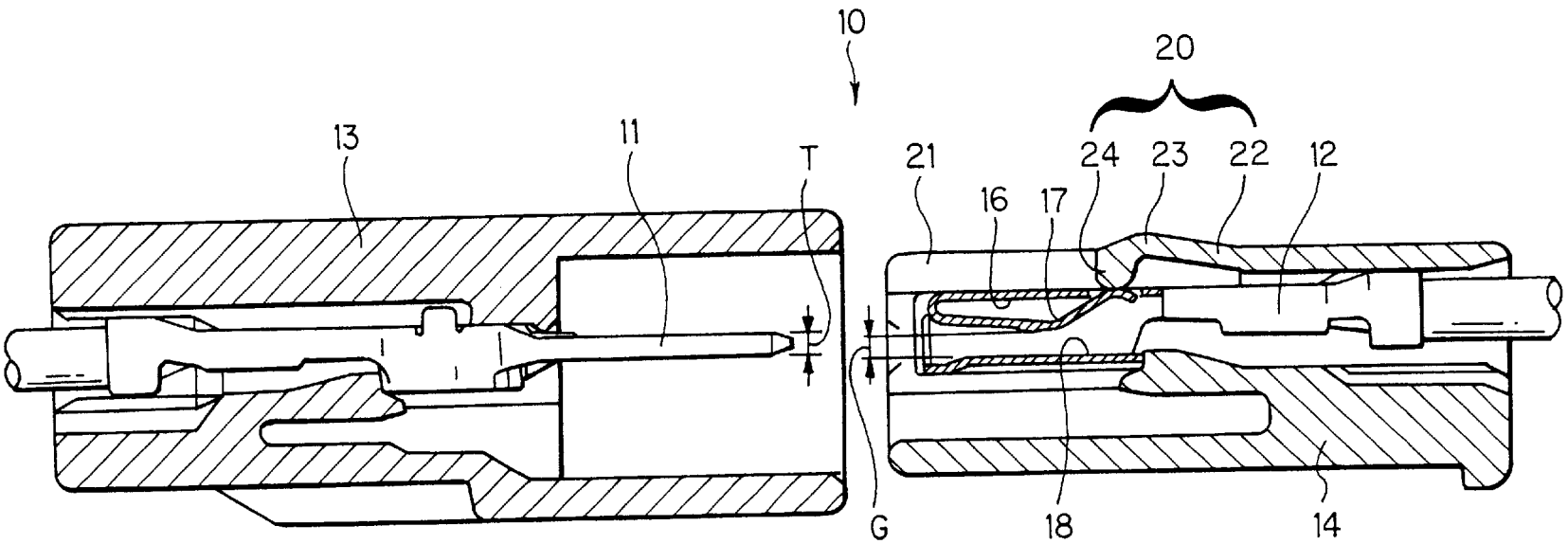
FIG. 1 is a cross-sectional view showing one preferred embodiment of a connector of the present invention.
Figure 2:
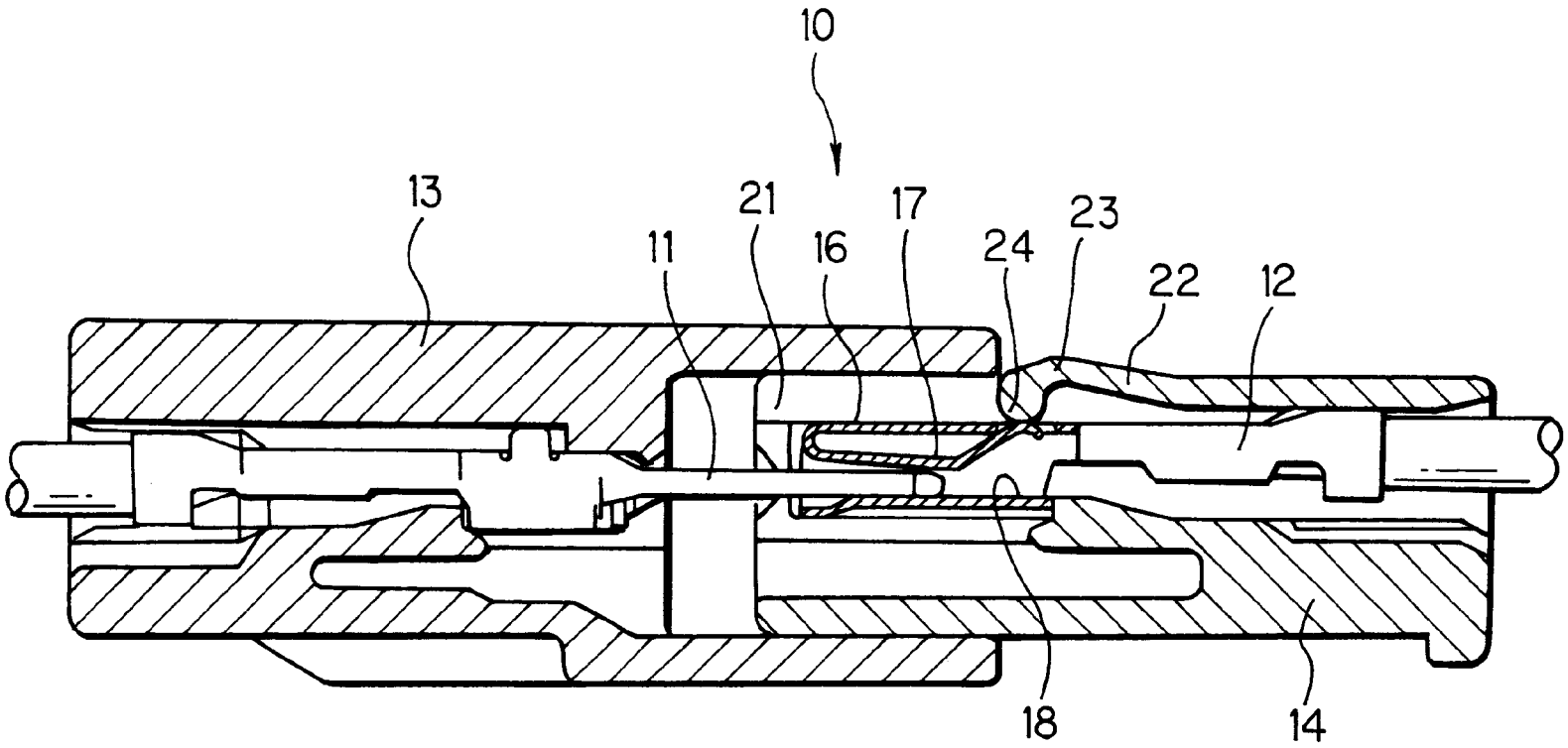
FIG. 2 is a cross-sectional view showing the process of inserting a female connector into a male connector.
Figure 3:
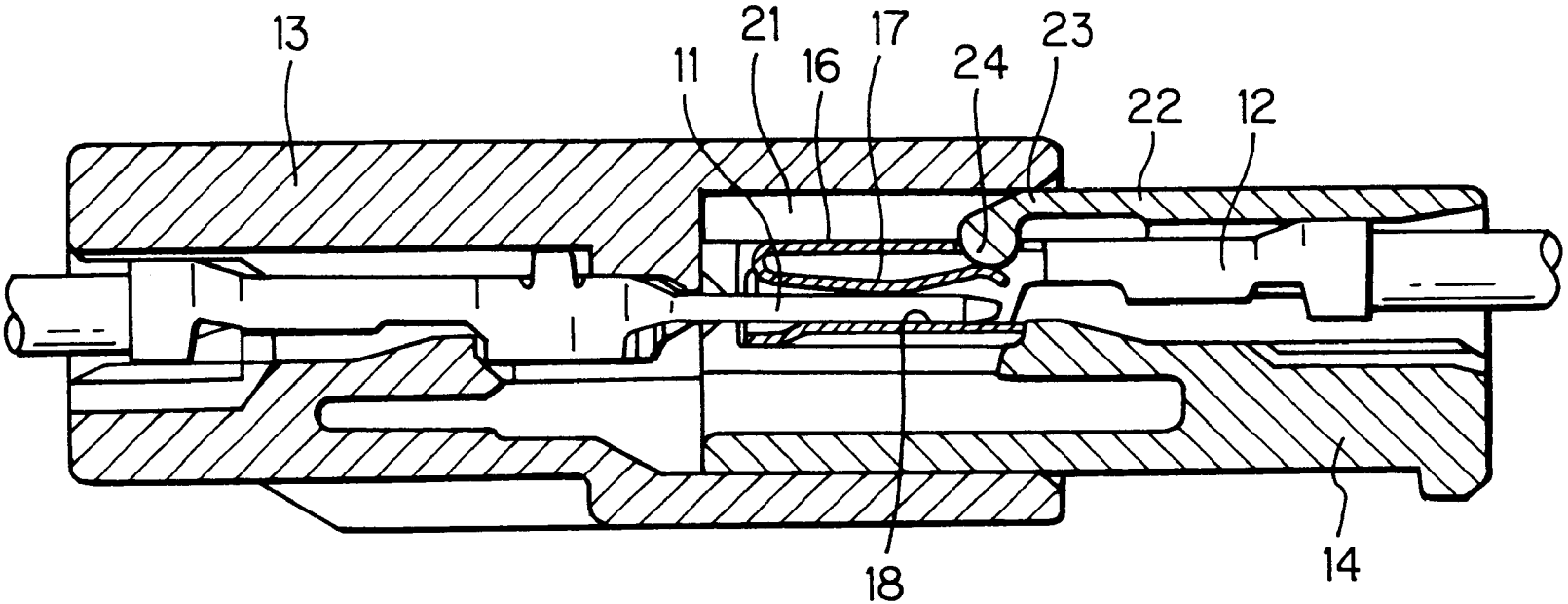
FIG. 3 is a cross-sectional view showing a condition in which the male and female connectors are connected together.

As shown in FIGS. 1 to 3, a connector 10 of this embodiment comprises a male connector 13 of a tubular shape, having a strip-like male terminal 11 received therein, and a female connector 14 of a tubular shape which has a female terminal 12 received therein, and can be generally telescopically inserted in and connected to the male connector 13 so that the male terminal 11 can be connected to the female terminal 12 capable of holding the male terminal 11 in a direction of a thickness thereof.

A curved strip-like holding piece portion 17 is formed integrally with a wall portion 16 of the female terminal 12, and a convexly-arcuate surface of this holding piece portion 17 is disposed in opposed relation to an inner surface of a wall portion 18 of the female terminal.

In this connector of the invention, the distance or gap G between the wall portion 18 and the holding piece portion 17 is not smaller than the thickness T of the male terminal 11, and there is provided pressing means 20 for pressing the holding piece portion 17 toward the wall portion 18 when the female connector 14 is inserted into the male connector 13.

The pressing means 20 includes a slit 21, formed in the female connector 14 and extending in a direction of the length of the female connector, and an arm member 22 provided in the slit 21.

The arm member 22 has a mountain-like cross-sectional shape, and is connected at its proximal end to an inner end edge of the slit 21 in such a manner that its angle portion projects outwardly beyond an outer surface of the female connector 14.

When the female connector 14 is inserted into the male connector 13, a projected portion 24 of the arm member 22, projecting outwardly beyond the outer surface of the female connector 14, is pressed by an inner surface of the male connector 13 to be retracted, and as a result the arm member 22 presses the holding piece portion 17 toward the wall portion 18 through a pressing portion 23 formed at a distal end of the arm member 22 (see FIG. 3).

In the connector 10 of this construction, the female connector 14 is first inserted into the male connector 13, and before the arm member 22 is pressed by the inner surface of the male connector 13, the male terminal 11 is inserted into the gap between the holding piece portion 17 and the wall portion 18 of the female terminal 12 with a very small insertion resistance (see FIG. 2).

Then, when the female connector 14 is further inserted into the male connector 13, the holding piece portion 17 is gradually pressed toward the wall portion 18 through the arm member 22, pressed by the inner surface of the male connector 13, so that the male terminal 11 is held between the holding piece-portion 17 and the wall portion 18 of the female terminal 12.

In this connector 10, the gap G between the holding piece portion 17 and the wall portion 18 of the female terminal 12 is not smaller than the thickness T of the male terminal 11, and when the female connector 14 is inserted into the male connector 13, the holding piece portion 17 is pressed toward the wall portion 18 by the pressing means 20. Therefore, the connection resistance, developing when connecting the male and female terminals 11 and 12 together, is much smaller as compared with the conventional construction, and besides the male and female terminals 11 and 12 can be positively connected together.

In this connector 10, it is only necessary that the male terminal 11 should finally be held between the holding piece portion 17 and the wall portion 18 through the pressing means 20, and therefore high precision is not required for the shapes, dimensions and positions of the constituent members, and therefore the cost of the parts can be reduced as compared with the conventional construction.

And besides, in the connector 10, the arm member 22, forming the pressing means 20, is provided on the female connector 14, and therefore existing parts can be used as the male terminal 11 and the male connector 13, and the overall cost can be reduced.

The present invention is not limited to the above embodiment, and suitable modifications and improvements can be made.

For example, in the above embodiment, although there is provided the pressing means for pressing the holding piece portion toward the wall portion of the female terminal, there may be used pressing means for pressing the pair of holding piece portions toward each other.

The material, shape, dimensions, form, number and position of the male terminal, the holding piece portion, the female terminal, the male connector, the female connector, the pressing means, the communication portion and the pressing means are not limited to those illustrated in the above embodiment, and may be suitably changed in so far as the invention can be achieved.

As described above, in the present invention, one of the holding portions is moved toward the other by the pressing means, and therefore the male and female terminals can be positively connected together with a small insertion resistance, and besides high precision is not required for the shape, dimensions and position of the constituent members, and therefore the cost of the parts is reduced as compared with the conventional construction.

In the invention, the pressing member, constituting the pressing means, is provided on the female connector, and therefore existing male terminal and male connector can be used.

What is claimed is:

1. A connector comprising:

a strip-like male terminal;

a female terminal having a pair of holding portions disposed in an opposed relation to each other, capable of holding said male terminal therebetween, said female terminal connected to said strip-like male terminal;

a male connector for accommodating said male terminal;

a female connector for accommodating said female terminal entirely within said female connector, said female connector being generally inserted in and connected to said male connector; and pressing means for pressing only one of said holding portions toward the other portion when said female connector is inserted into said male connector.

2. A connector according to claim 1, in which said pressing means includes a communication portion, formed through a wall of said female connector in a direction of a thickness thereof, and a pressing member received in said communication portion, and said pressing member projects outwardly beyond an outer surface of said female connector, and is held in contact with one of said holding portions.

* * * * *